United States Patent [19]

Tribbey

[11] Patent Number: 4,817,369

[45] Date of Patent: Apr. 4, 1989

[54] APPARATUS FOR ENVELOPE INSERTION AND STACKING

[75] Inventor: Lawrence S. Tribbey, San Mateo, Calif.

[73] Assignee: Machine Development Company, Inc., Dublin, Calif.

[21] Appl. No.: 35,028

[22] Filed: Apr. 6, 1987

Related U.S. Application Data

[63] Continuation of Ser. No. 865,383, May 20, 1986, abandoned, Continuation of Ser. No. 777,198, Sep. 18, 1985, abandoned, Continuation of Ser. No. 573,010, Jan. 23, 1984, abandoned.

[51] Int. Cl.[4] ..... B65B 43/26; B65B 43/39; B65B 43/18

[52] U.S. Cl. ..... 53/571; 53/266 A

[58] Field of Search ..... 53/55, 250, 251, 254, 53/260, 266 A, 532, 540, 569, 570, 571

[56] References Cited

U.S. PATENT DOCUMENTS

| | | | |
|---|---|---|---|
| 2,325,455 | 7/1943 | Williams | 53/571 |
| 2,736,999 | 3/1956 | Rouan et al. | 53/569 |
| 3,370,549 | 2/1968 | Livingston | 53/540 |
| 3,423,900 | 1/1969 | Orsinger | 53/571 |
| 3,633,739 | 1/1972 | Renner et al. | 53/540 |
| 3,641,735 | 2/1972 | Dailey et al. | 53/540 |
| 4,020,615 | 5/1977 | Irvine et al. | 53/266 A |
| 4,337,609 | 7/1982 | Foster et al. | 53/569 |

FOREIGN PATENT DOCUMENTS

| | | | |
|---|---|---|---|
| 1088792 | 9/1960 | Fed. Rep. of Germany | 53/571 |

*Primary Examiner*—Horace M. Culver
*Attorney, Agent, or Firm*—Patrick J. Walsh

[57] ABSTRACT

A machine for inserting discs into envelopes including a disc conveyor in which discs are removed one by one from a stack and conveyed past a detecting station to a loading station together with an envelope conveyor in which envelopes from the hopper are conveyed to the loading station in advance of arrival of discs and positioned for receiving the disc through the open end of the envelope. The operation of the envelope conveyor is initiated by passage of a disc by the detecting station so that unless a disc is moving no envelope is picked from the envelope stack. After package formation the packages are conveyed to a transfer conveyor past a detector which determines a predetermined stack of conveyors for each station on the transfer conveyor.

18 Claims, 16 Drawing Sheets

APPARATUS FOR ENVELOPE INSERTION AND STACKING

This application is a continuation of application Ser. No. 865,383, filed May 20, 1986, now abandoned, which is a continuation of application Ser. No. 777,198, filed Sept. 18, 1985, now abandoned, which is a continuation of application Ser. No. 573,010, filed Jan. 23, 1984, now abandoned.

BACKGROUND OF THE INVENTION

Discs commonly known as floppy discs or diskettes have come into widespread use in connection with automatic typewriters and word processing equipment. A diskette includes a recording media enclosed within a protective pouch. These diskettes are thereafter packaged in envelopes to protect them from damage to the recording media which is exposed on one end to the "read/write" slot.

In present practice, discs are packaged into envelopes by hand or by relatively slow and complicated machinery since the envelopes must be opened and held open during packaging for disc insertion without catching the edges of the envelope open end with the edge of the disc.

SUMMARY OF THE INVENTION

Accordingly, the present invention provides a machine for inserting discs, especially floppy discs into envelopes at high rates of speed. A machine operator supplies stacks of discs and envelopes to hoppers on the machine. The machine thereafter inserts each disc into an envelope and organizes stacks of a predetermined count of stuffed envelopes for delivery to a take-away conveyor. The machine is capable of inserting discs into envelopes at speeds of up to 120 units per minute.

The machine of the present invention includes a first conveyor for removing the bottom diskette from the diskette hopper. The emerging diskette blocks a photoelectric eye for activating an envelope picker for removing a corresponding envelope from the envelope hopper to a second continuously moving conveyor. The envelope arrives first at a loading station and is held in position for the arriving diskette. The arriving diskette is engaged at its rear edge by a pair of traveling pushers or fingers moving in timed relationship with the diskette conveyor so that the diskette is pushed into its envelope.

A movable envelope stop engages the leading edge of the envelope and holds it at the loading station. Additionally, the envelope is "bent backwards" over a curved surface and the envelope top flap is held down so that the opposite edge of the envelope bows open in a reliable manner for receiving the diskette. As the traveling pushers or fingers move the disc into the envelope, they also move the envelope stop out of the way. The stuffed envelope or package then moves to a bucket conveyor which forms stacks of packages of predetermined count.

The bucket conveyor assures an accurate count in each stack by providing a gate for separating newly delivered packages above the predetermined count and for delivering the excess to the next bucket. When the proper count is reached the bucket advances to a discharge station where a push-off ram empties each bucket onto a table or a take-away conveyor.

OBJECTS OF THE INVENTION

An object of the invention is to provide a machine for stuffing diskettes into envelopes at high speeds, forming up to 120 packages per minute.

Another object of the invention is to provide a machine for stuffing diskettes into envelopes in which both envelope and diskette are removed one at a time from respective loading hoppers and delivered in time relation to a loading station.

Another object of the invention is to provide a machine having a loading station which reliably opens each envelope to a maximum degree assuring accurate and reliable loading of a diskette into the envelope.

Another object of the invention is to provide a discharge conveyor for receiving and stacking diskette/envelope packages in predetermined count for removal to a take-away conveyor.

A further object is to provide a machine of sturdy and reliable construction for inserting floppy discs into envelopes needing minimal attention from its operator.

Other and further objects of the invention will become apparent through an understanding of the following detailed description of the preferred embodiment or upon employment of the invention in practice.

A preferred embodiment of the invention has been chosen for describing the principles of the invention and is illustrated in the drawing in which.

Figure 12:
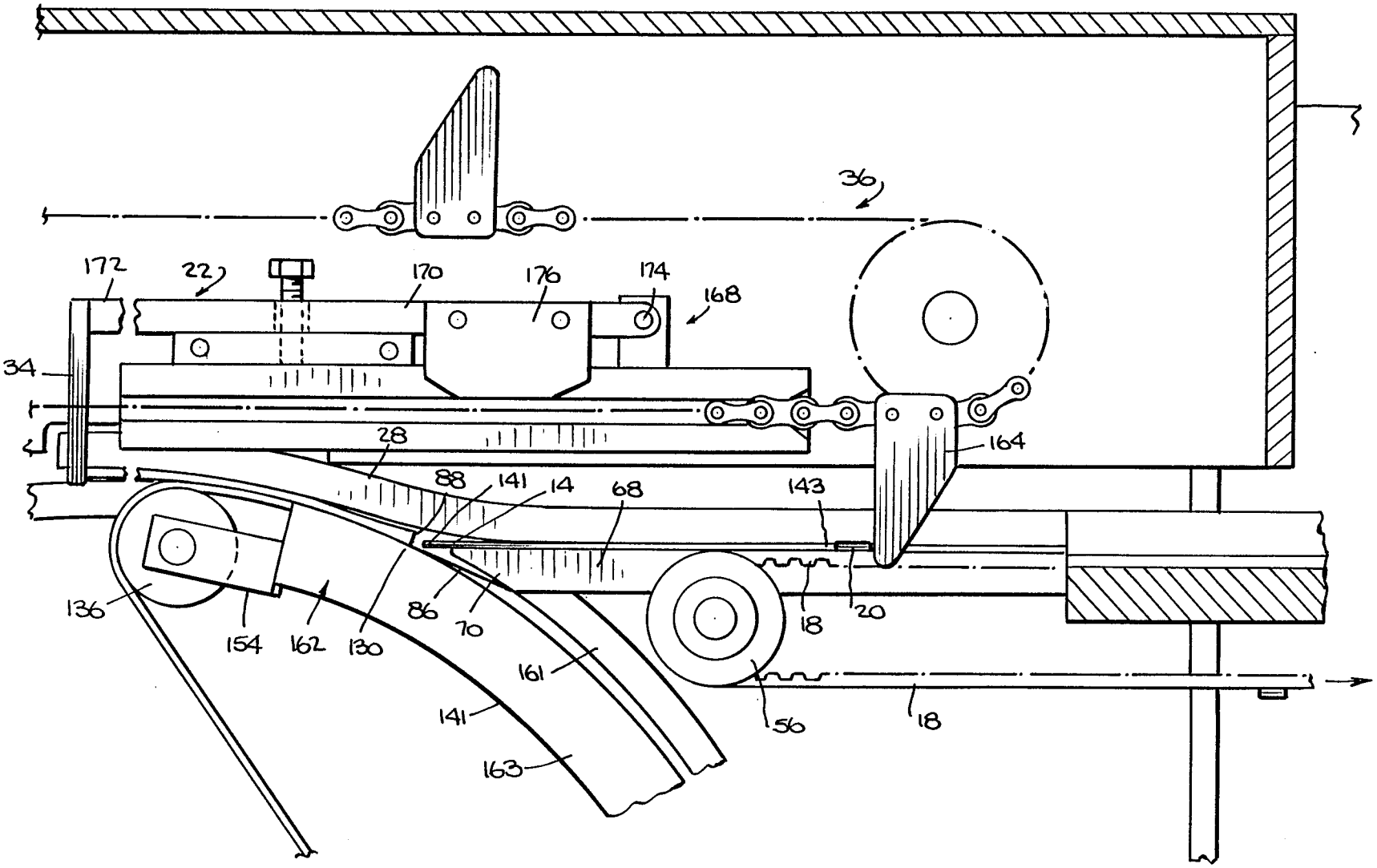
Figure 14:
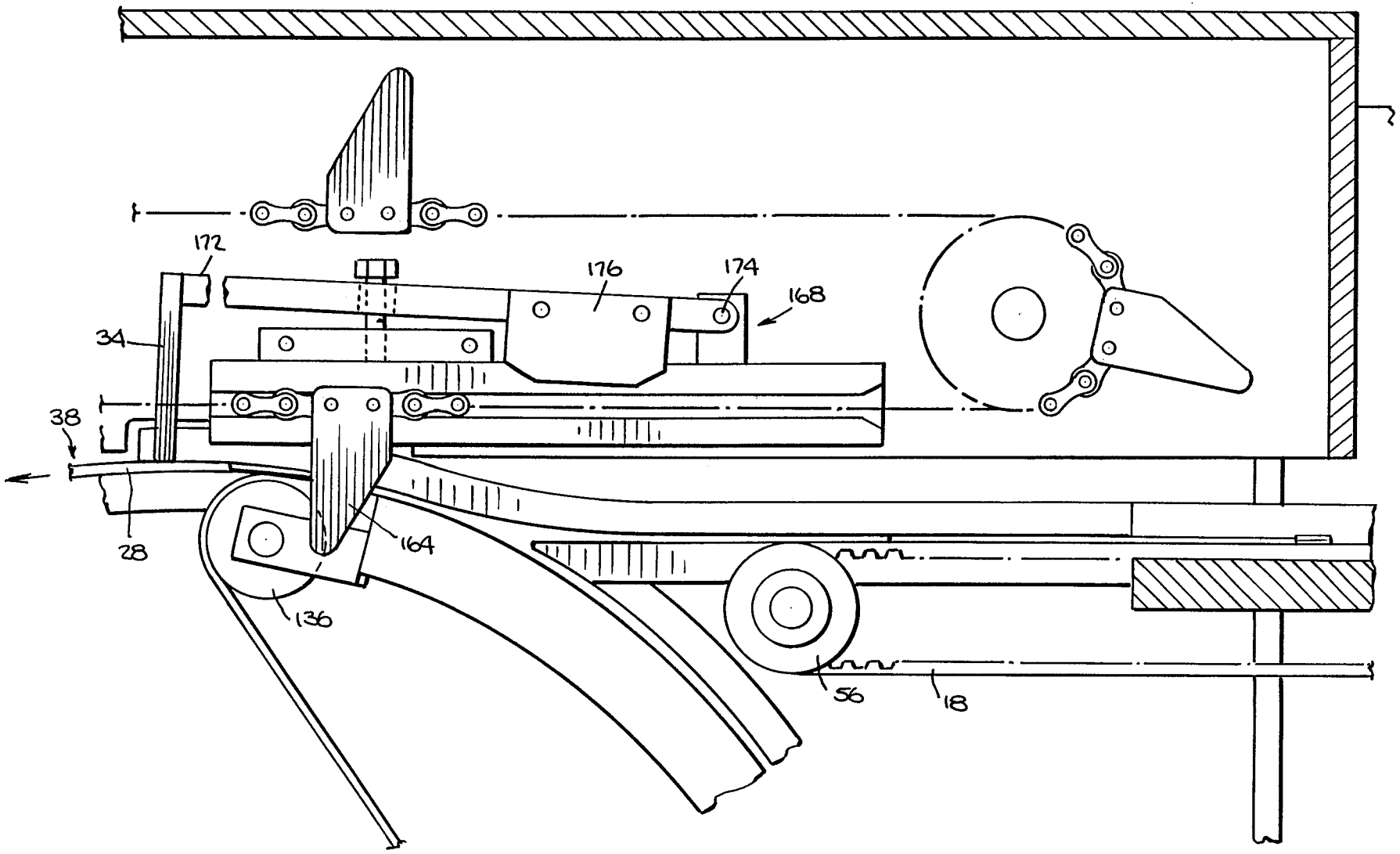

FIGS. 12, 13, and 14 are sequential views of the loading station of the machine illustrating (i) position of envelope at loading station ready to receive diskette; (ii) diskette inserted into envelope and lifting of envelope stop; and (iii) discharge of diskette/envelope package as following envelope and diskette arrive at loading station.

Figure 15:
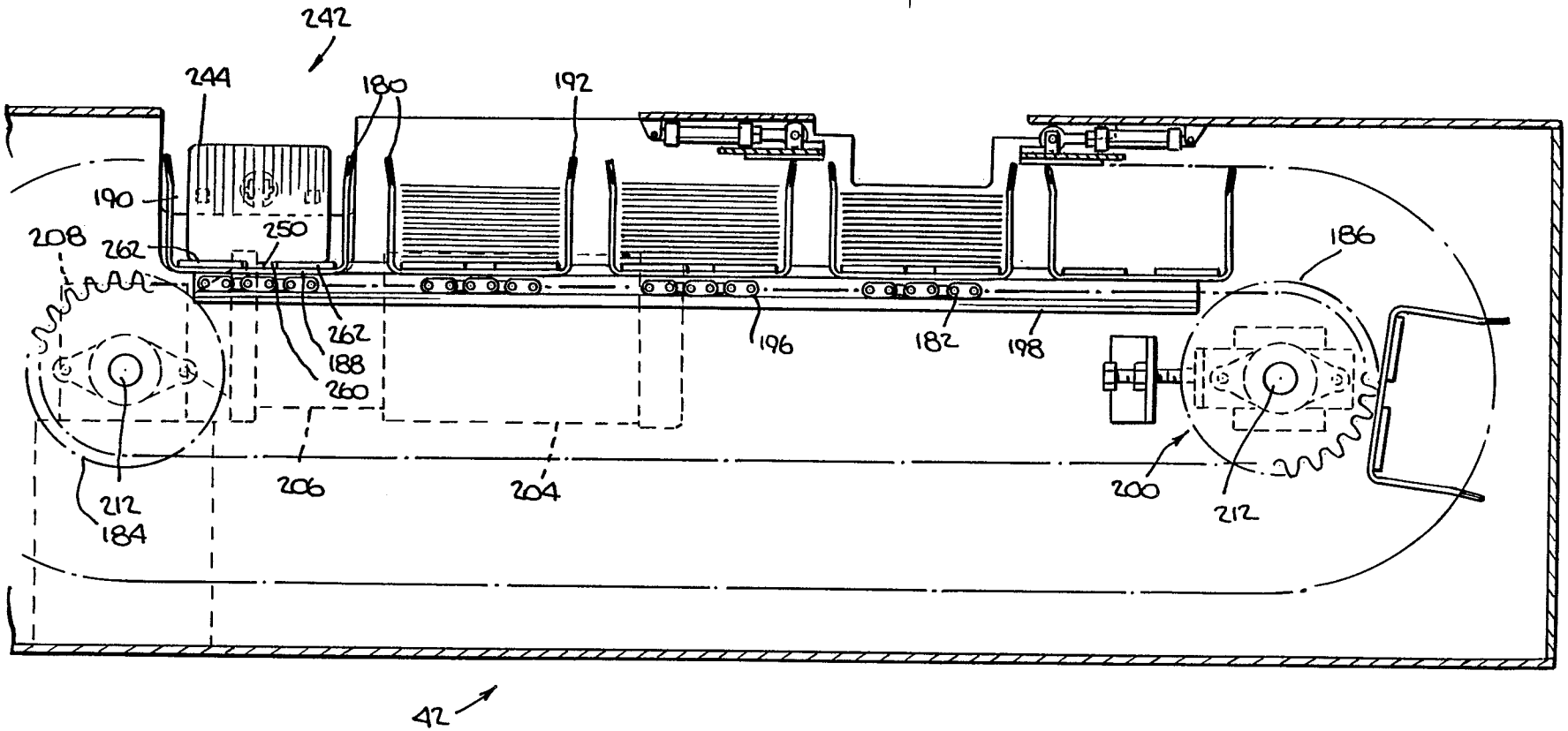

FIG. 15 is a rear elevational view of the envelope inserter and stacker machine showing the stacking conveyor with stacking buckets at loading and take-away stations.

Figure 16:
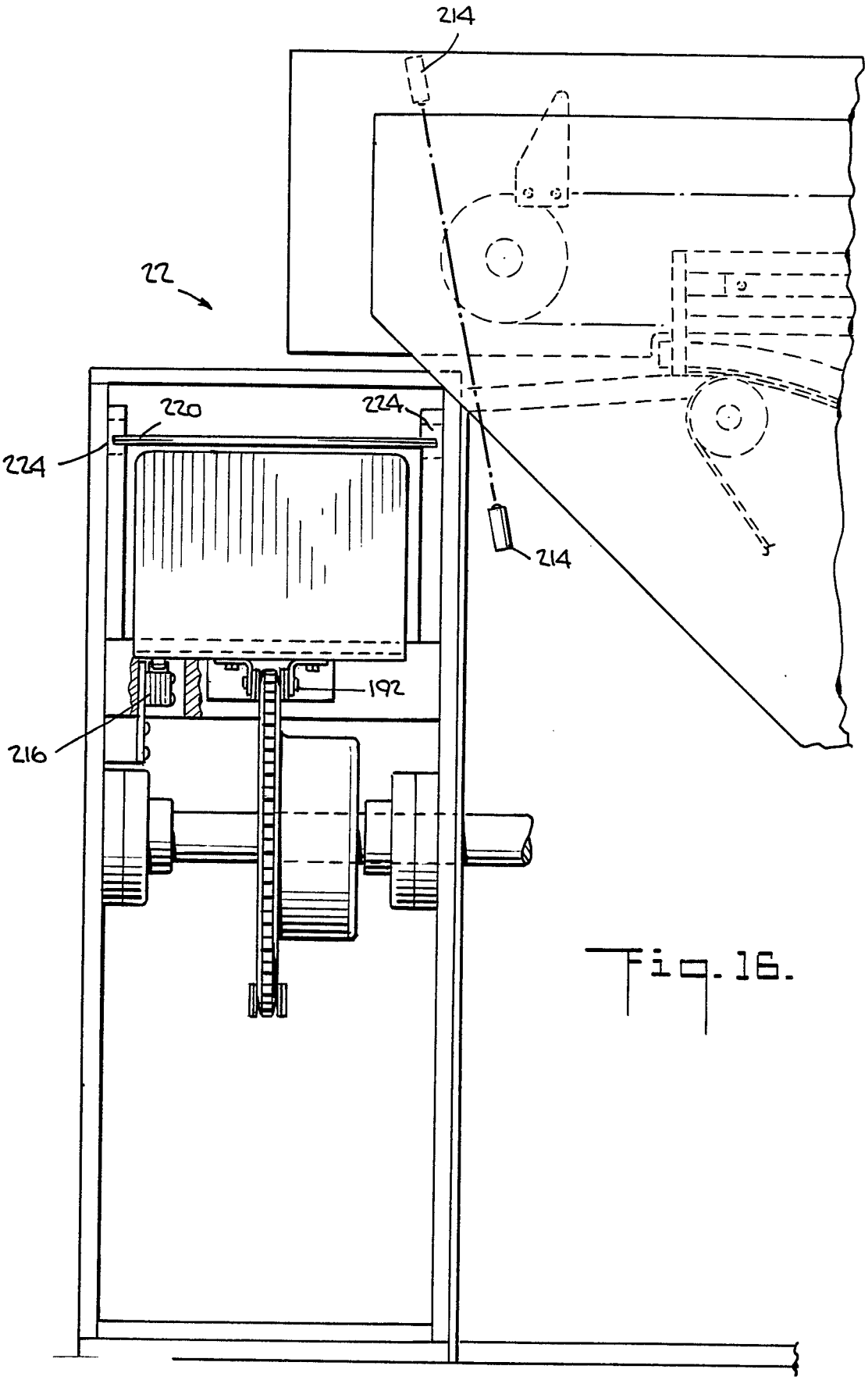

FIG. 16 is a partial side elevation of the machine illustrating an end view of the stator conveyor with a bucket at the loading station.

Figure 17:
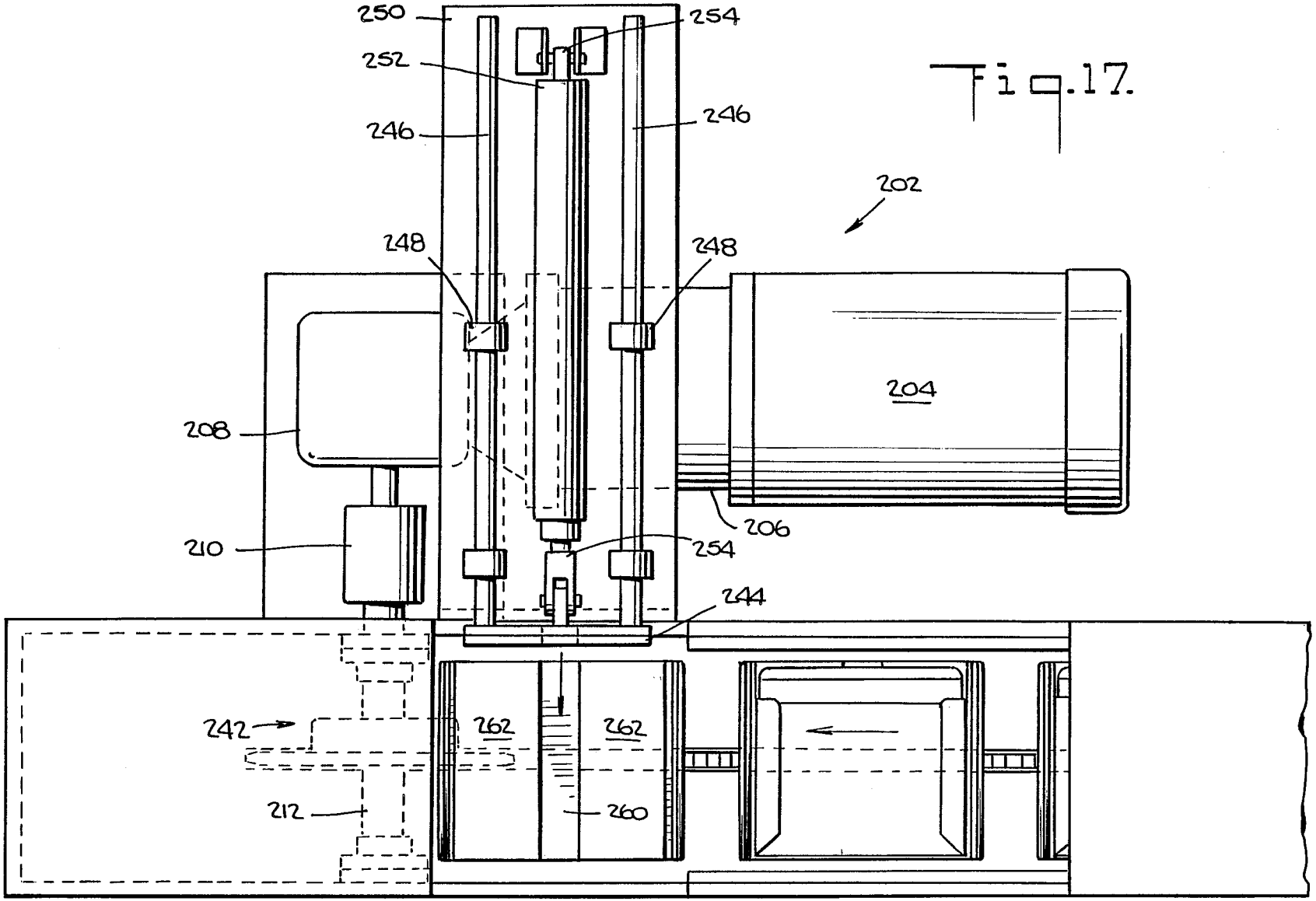
Figure 10:
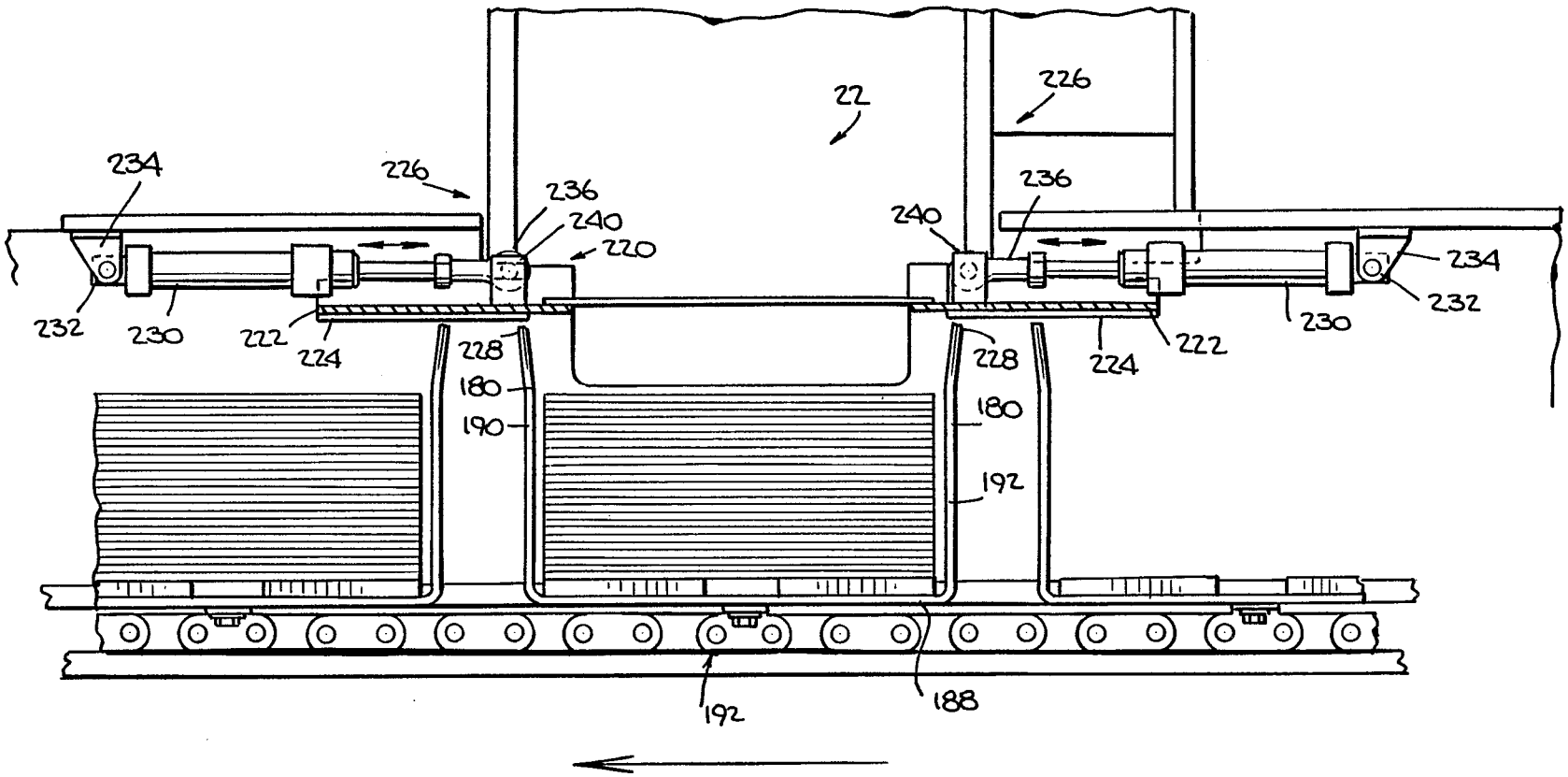
Figure 19:
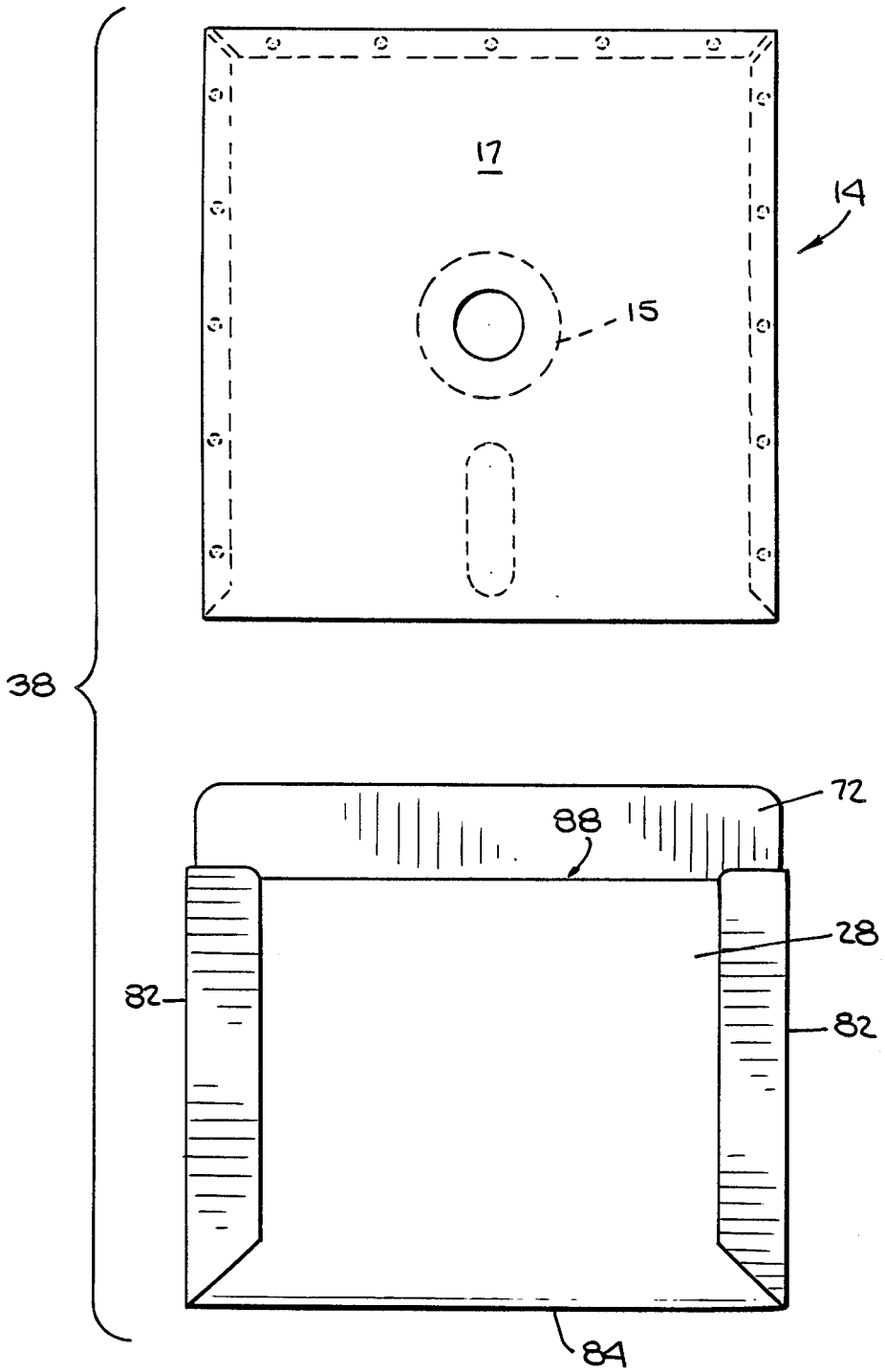

FIG. 17 is a top plan view of the stacking conveyor illustrating the discharge ram for moving stacked packages from the stacking conveyor to a table or take-away conveyor.

FIG. 18 is a fragmentary rear elevation view of the stacking conveyor with a bucket at the loading station and illustrating the counting gates.

Figure 19:
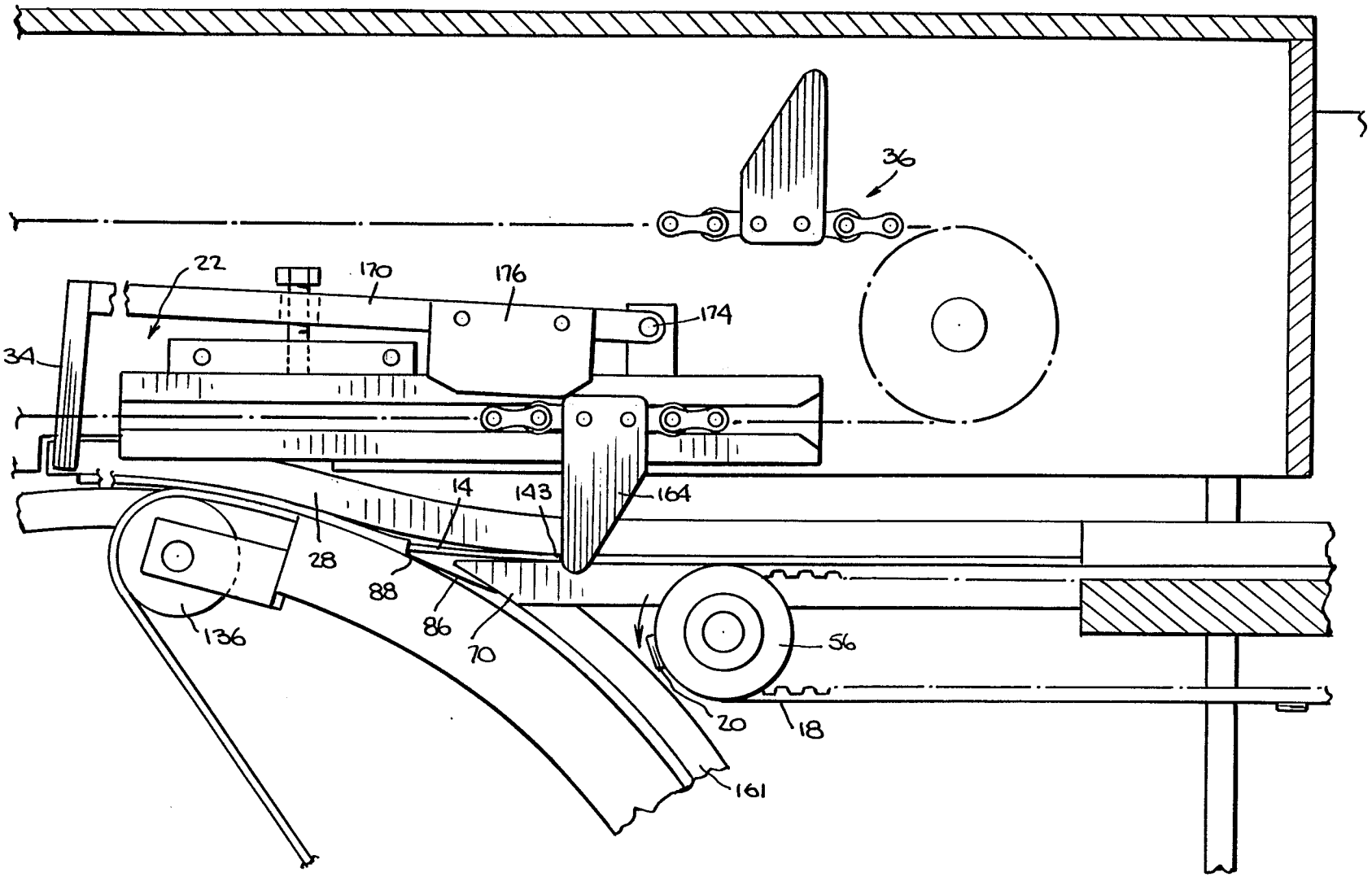

FIG. 19 is an exploded view showing package consisting of diskette and envelope.

OVERALL ARRANGEMENT

Figure 1:
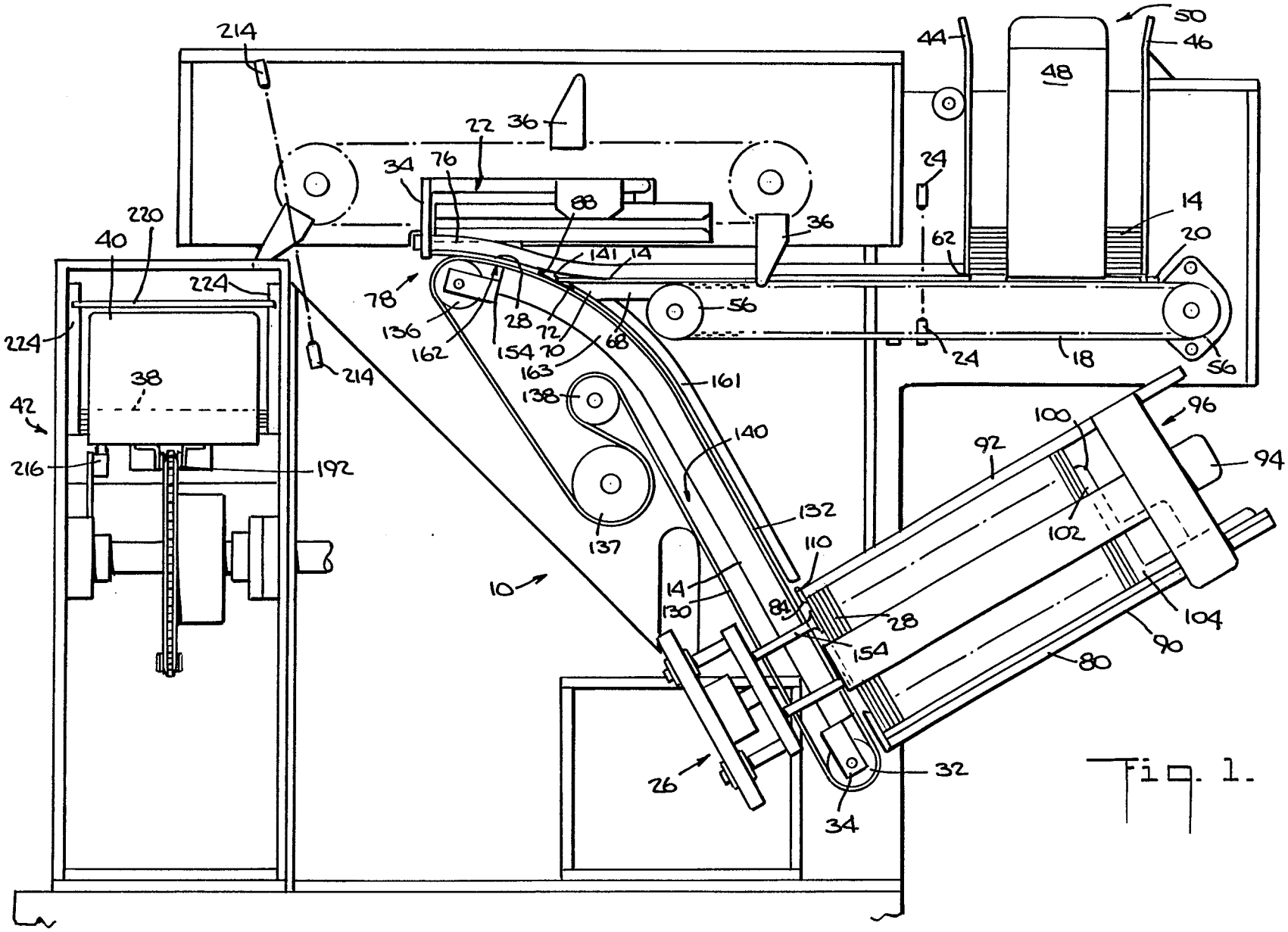
FIG. 1 is a side elevation of the machine of the present invention, shown schematically, and illustrating hoppers and conveyors for moving diskettes and envelopes to the loading station, envelope loading position, diskette pusher, and the discharge bucket conveyor.

Referring to FIG. 1 the machine 10 according to the present invention includes a hopper 12 for stacking diskettes 14 which may be loaded manually into the hopper by a machine attendant. A continuously moving conveyor 16 preferably comprising a gear belt 18 having spaced cleats 20 picks a diskette 14 and moves it to the loading station 22.

As this occurs and prompted by a photoelectric eye 24, the envelope picker 26 removes one envelope 28 from the bottom of the envelope stack 30 to a vacuum belt 32 at each speed and in timed relation to diskette movement so that envelope arrives first coming to rest at the envelope stop 34 and bent backward to receive the arriving diskette 14. The cleated gear belt 18 moves the diskette 14 into position for engagement at its rear edge by overhead pushers 36 which push the diskette into the envelope. The overhead pusher assembly 36 thereafter lifts the envelope stop and moves the package 38 into the waiting bucket 40 of the stacking conveyor 42.

The completed package 38 is shown in FIG. 19 and includes diskette 14 with recording media 15 and pouch 17 and envelope 28.

DISKETTE HOPPER AND CONVEYOR

Figure 2:
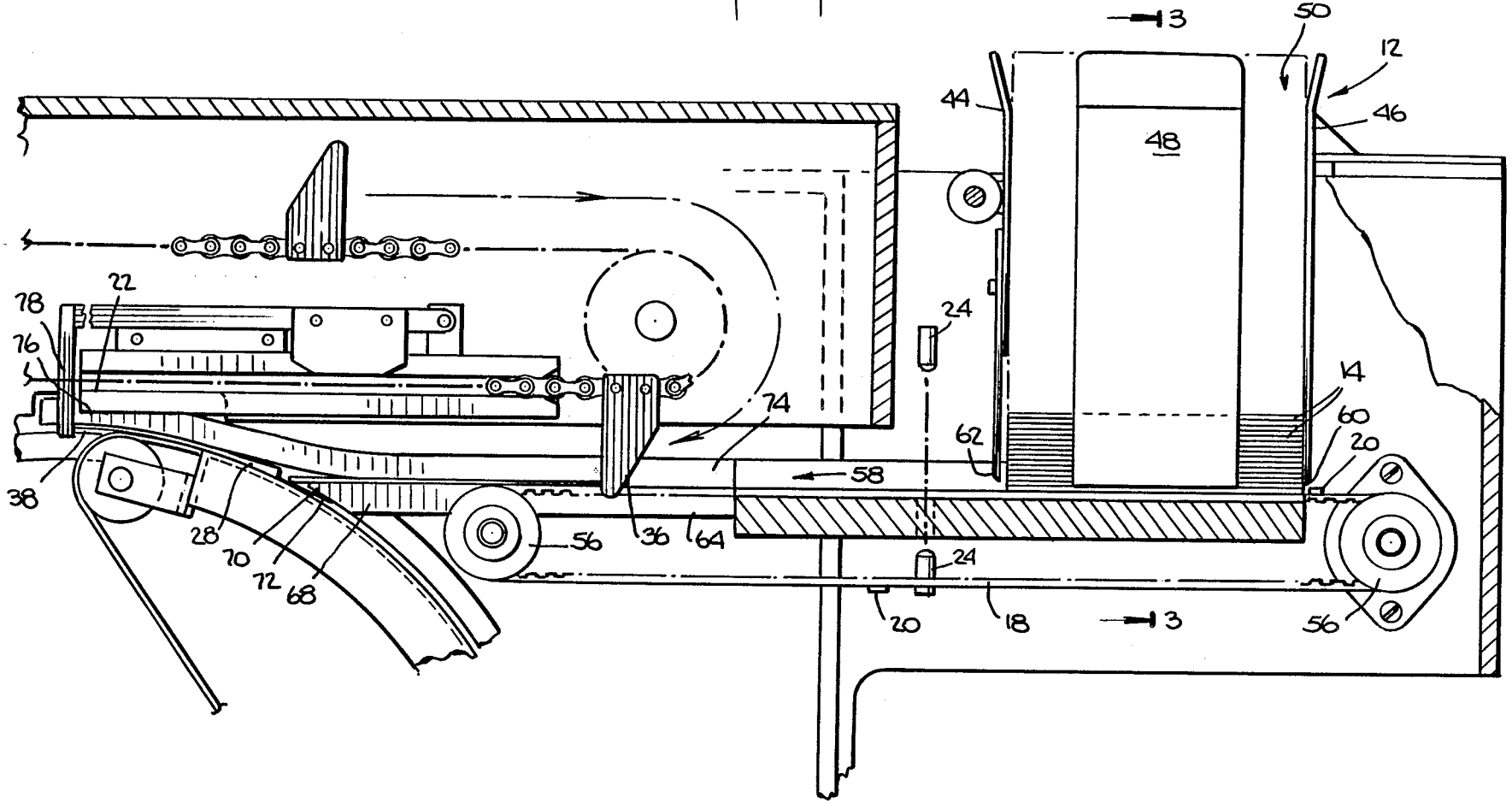
FIG. 2 is a side elevation of the diskette hopper and the conveyor for removing diskettes from the bottom of the hopper.
Figure 3:
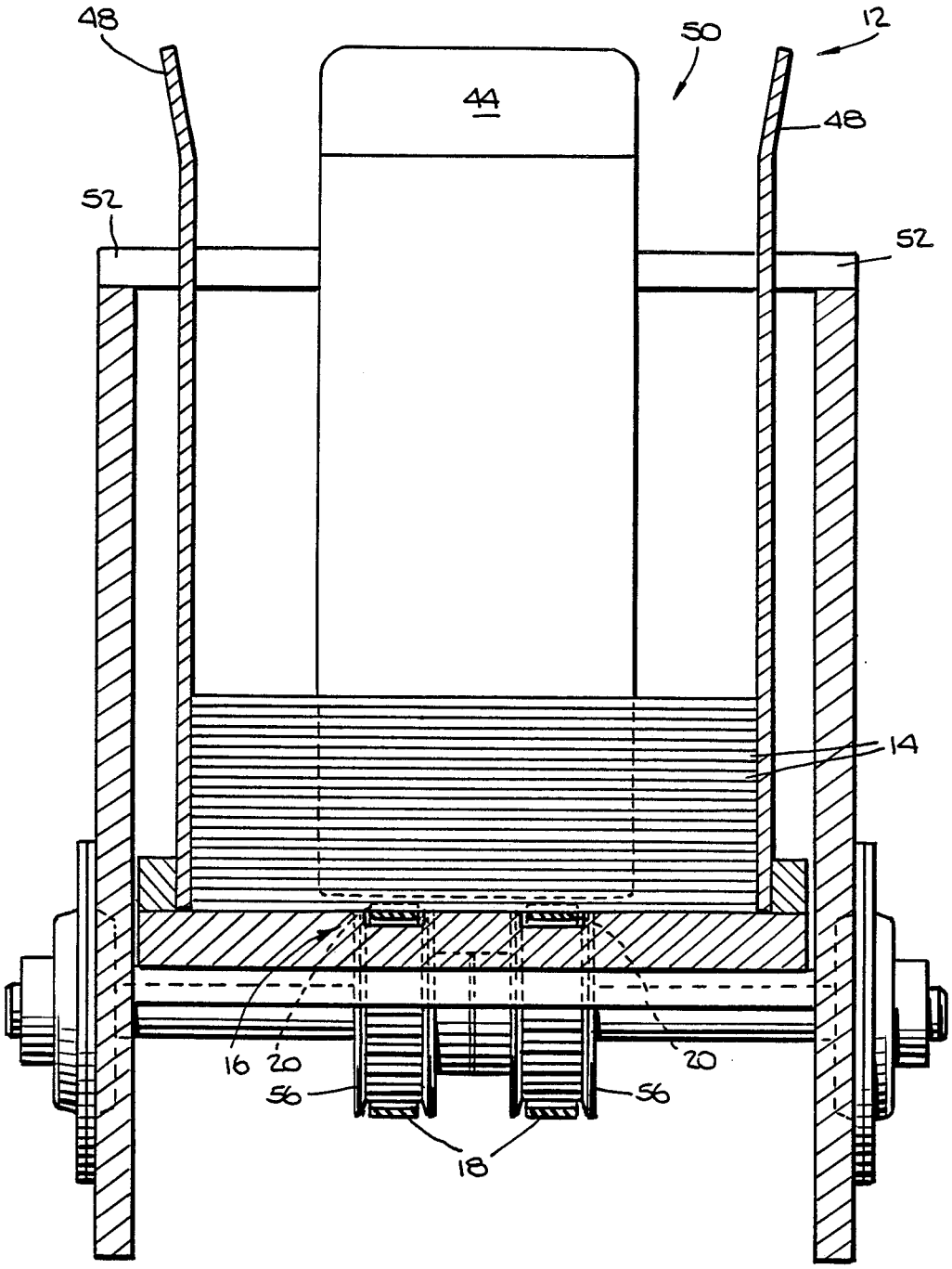
FIG. 3 is a sectional view taken along line 3—3 of FIG. 2.

Referring now to FIGS. 1, 2 and 3, the diskette hopper 12 is generally vertically arranged and comprises suitable upstanding front 44, rear 46, and side wall 48 members defining an interior chamber 50 of suitable configuration for receiving and neatly stacking diskettes 14. The hopper is fixed to the machine frame by spaced support members 52. The individual walls are adjustable to modify the configuration of the interior hopper chamber in order to receive different sized diskettes.

The diskette hooper 12 is positioned above a gear belt conveyor 16 which preferably has spaced endless timing belts 18 arranged over sprockets 56 and defining a conveying path 58 between the diskette hopper 12 and the loading station 22. Each belt surface is fitted with a plurality of cleats 20 preferably three with adjacent cleats on the spaced belts being aligned to cooperate in engaging the trailing edge 60 of the bottom diskette in the hopper to push the diskette out from under the stack advancing it to the loading station 22.

Figure 4:
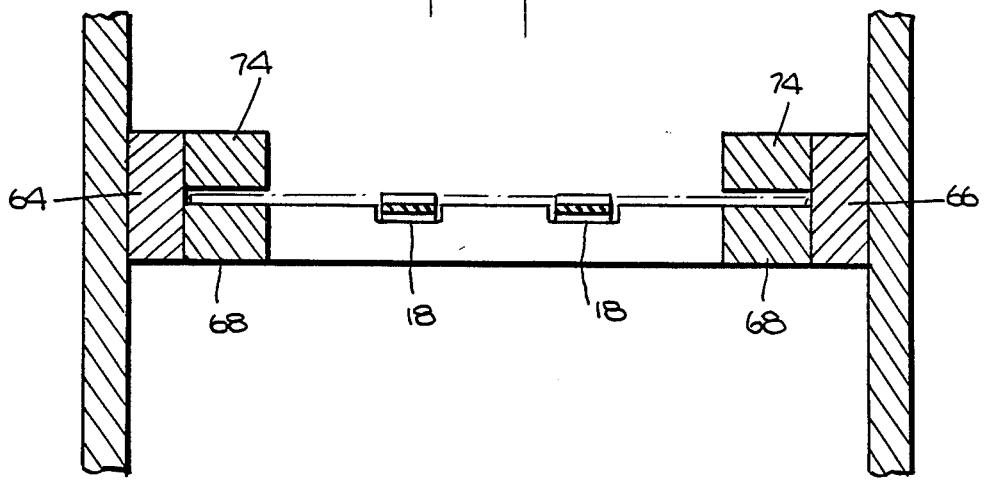
FIG. 4 is a sectional view of the diskette conveyor taken along line 4—4 of FIG. 1.

The front wall 44 of the diskette hopper is fitted with a rake 62 for restraining forward movement of stack of diskettes above the bottom one. The rake is adjustably mounted for spacing above the conveying belts a distance slightly greater than diskette thickness. As shown in FIGS. 2 and 4, the diskette 14 enters a pair of opposed guide members 64, 66 located on opposite sides of the gear belt conveyor. The diskette guide members each comprise a lower guide rail 68 originating within the conveying path of the gear belt conveyor and extending beyond that conveying path for guidng the diskettte to the loading station 22. The terminal portion 70 of the lower guide rail 68 includes a curved surface or end face positioned at the margin of the envelope conveying path and forming part of the loading station. As shown in FIG. 2, the curved surface of lower guide rail engages the top flap 72 of the envelope for back bending the envelope 28 for loading, a feature of the invention elaborated below in greater detail.

The diskette upper guide rails 74 originate at the same location as the lower rails and include an arcuate portion 76 extending above the loading station 22 to serve as upper guide for envelopes at the loading station in cooperation with the terminal portion 78 of the envelope conveyor and the envelope stop.

As shown in FIG. 2, the diskette conveyor 16 is fitted with a photoelectric eye system 24 which detects each diskette being conveyed and on doing so activates the envelope picking mechanism 26.

ENVELOPE PICKING MECHANISM AND CONVEYOR

Figure 5:
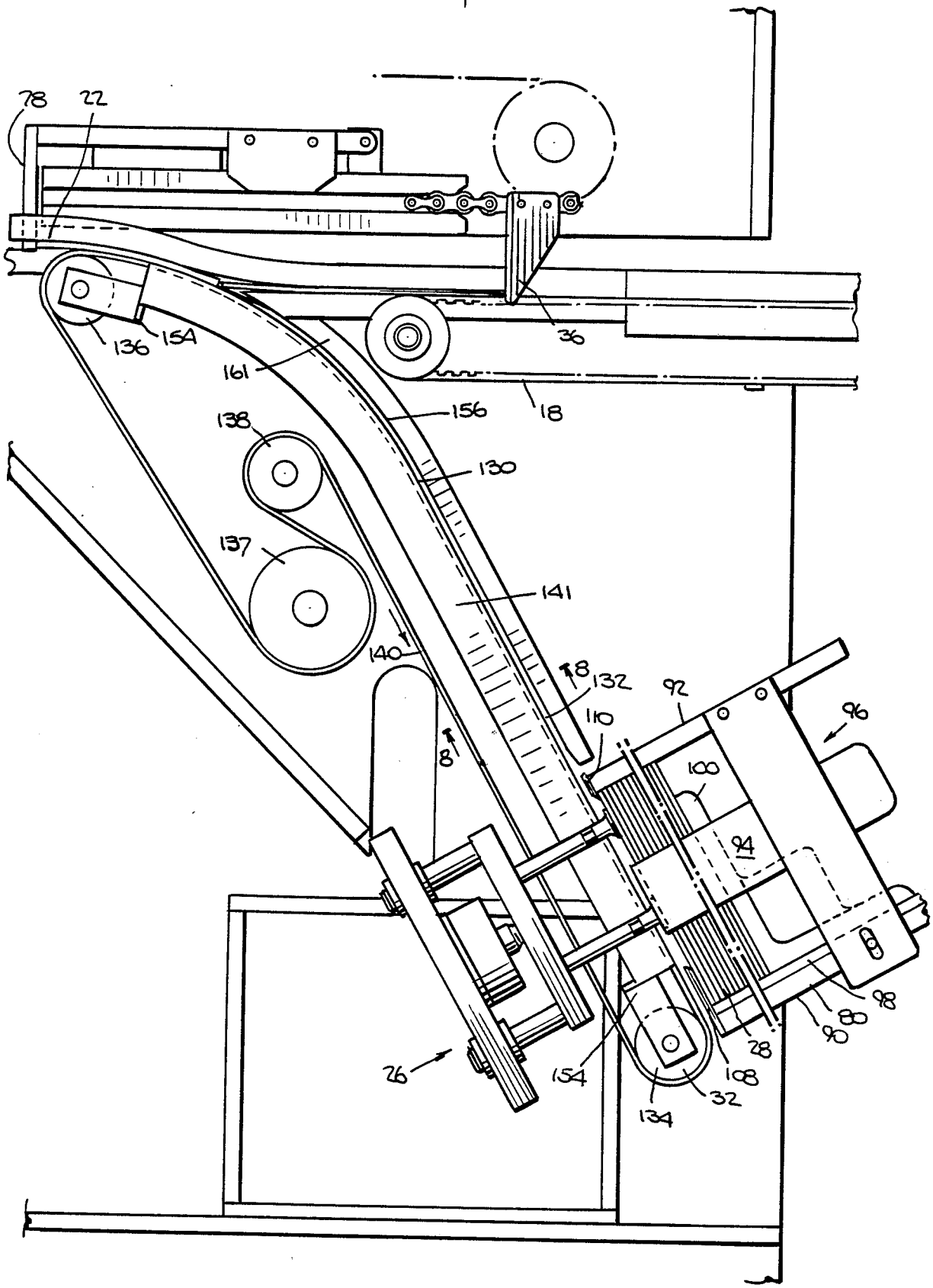
FIG. 5 is a side elevation view of the envelope hopper and conveyor for storing and moving envelopes one-by-one up to the loading station.

Referring to FIGS. 1 and 5, envelopes 28 are stacked in a hopper 80 by the machine attendant, removed one-by-one by a picking mechanism 26, and moved by a vacuum belt conveyor 32 to the loading station 22. Each envelope is of suitable shape preferably square and is sealed along opposing sides 82 and along the bottom 84. A top flap 72 extends beyond the open end 88 of the envelope in the usual manner as shown in FIG. 19.

The envelope hopper 80 comprises bottom 90 and top walls 92 as well as side guides 94 for defining a hopper chamber 96 of suitable internal configuratin for receiving envelopes 28 with open end 88 down and facing the bottom wall 90. The bottom wall of the hopper may be lined with a low friction surface 98 such as an ultra-high molecular weight polyethylene for smooth and reliable progression of the stack of envelopes down the hopper to the picking mechanism. Movement of the envelope in a reliable manner is further aided by a follower weight 100 in the shape of an angle iron having a foot portion 102 resting on top of the envelope stack and a leg portion 104 engaging the smooth liner of the hopper bottom wall. The open end 106 of the hopper includes a retainer shoulder 108 mounted perpendicular to the bottom wall and extending partially across the open end for supporting the stack of envelopes 30 at their open ends. A retaining clip 110 is mounted along the top wall for supporting the envelopes at their bottom edges 84. The retaining clip retains the second envelope in the stack as the first is being picked from the bottom of the stack by the picking mechanism.

An envelope picking mechanism 26 is located in confronting relationship to the open end 112 of the envelope hopper. The picker is actuated by the photoelectric detector 24 and removes the bottom envelope from the stack depositing it on a conveyor belt 32 moving across the open end of the hopper to the loading station 22.

Figure 6:
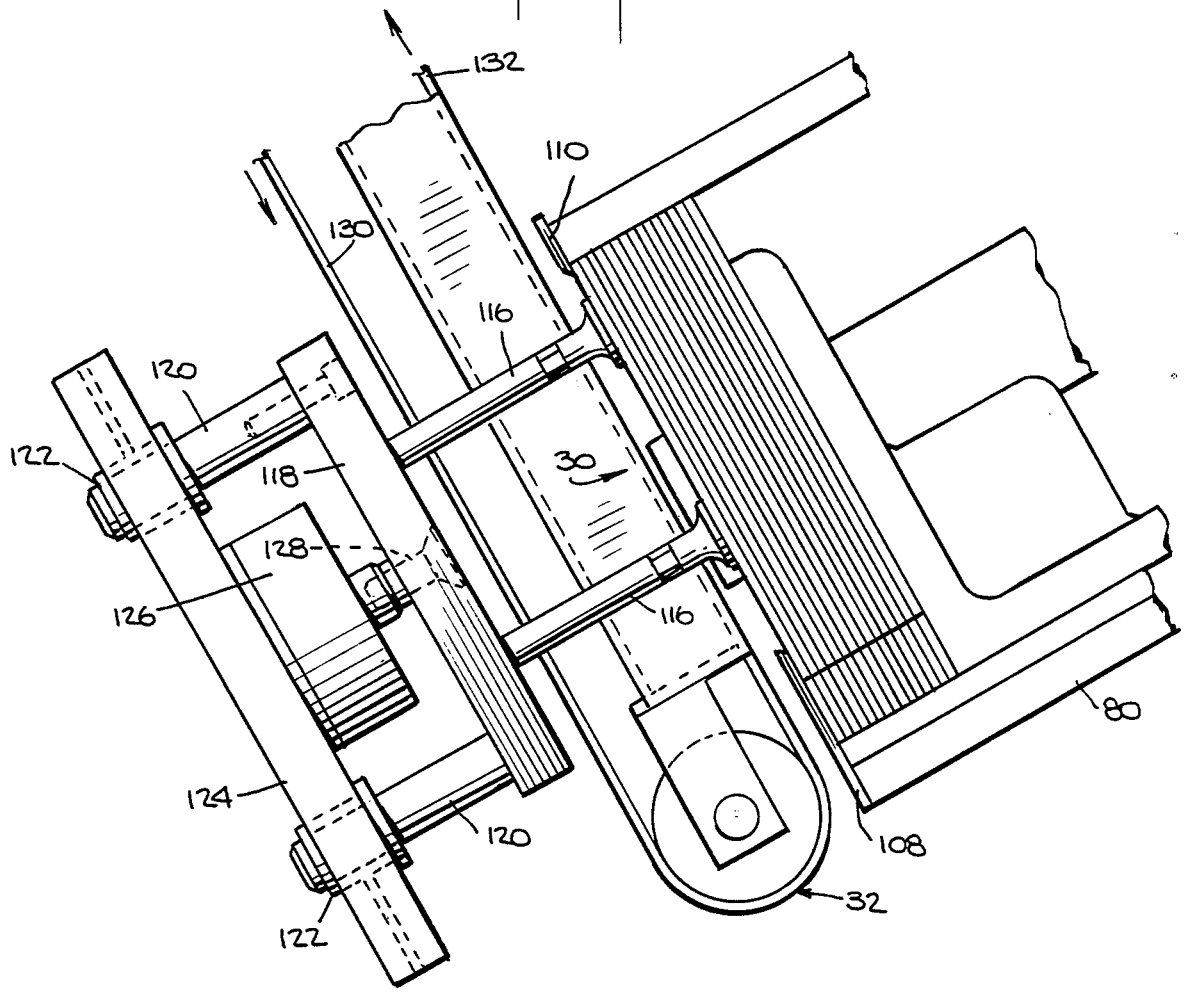
FIG. 6 is a side elevation view of the mechanism for picking envelopes from the envelope hopper.
Figure 7:
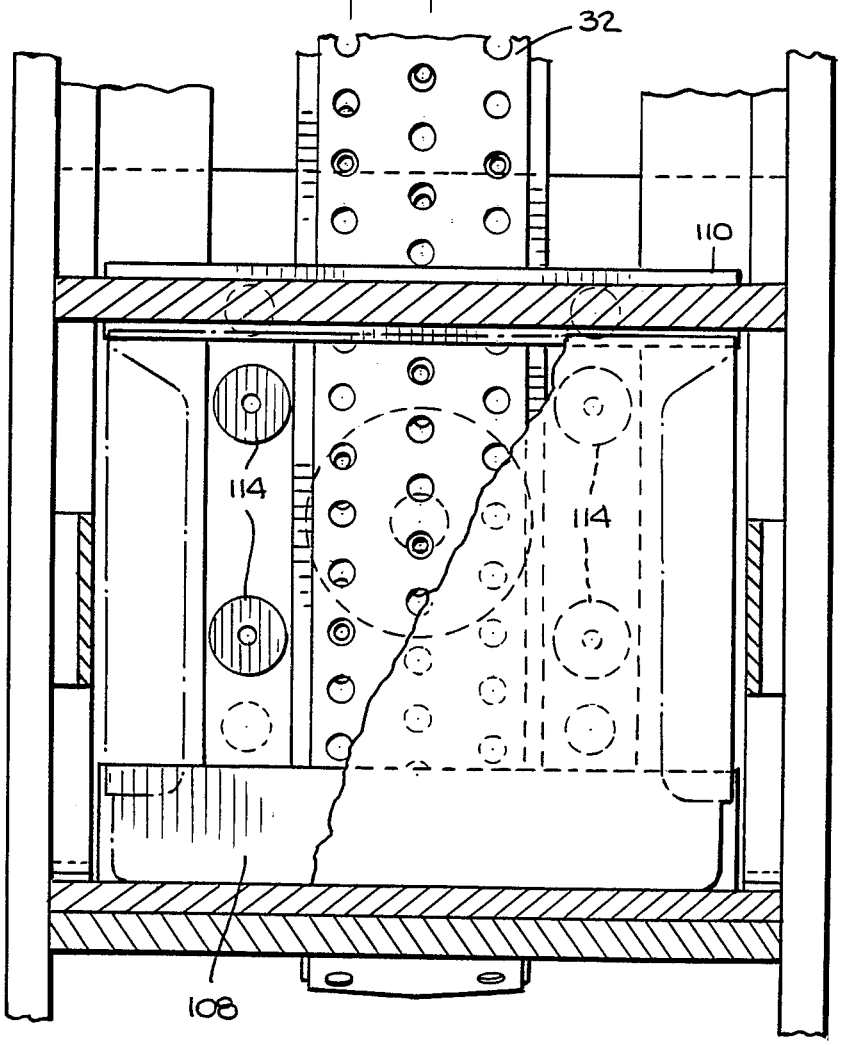
FIG. 7 is a section view taken along line 7—7 of FIG. 6.

As best shown in FIGS. 6 and 7, the envelope picker includes a plurality, preferably four, suction cups 114 with two cups lying on either side of the envelope conveyor belt. The suction cups are mounted by suitable tubes 116 to an evacuated plenum chamber 118 which is connected to a vacuum source not shown. The plenum chamber is mounted by spaced shafts 120 which are free to reciprocate in bushings 122 fitted in a fixed base plate 124. An air cylinder 126 mounted on the base plate, includes a connecting rod 128 for reciprocating the plenum chamber and suction cups for the purpose of removing the bottom envelope in the stack and depositing it on the conveyor belt. The stroke of the suction cups is sufficient to firmly engage the bottom envelope in the stack, removing it onto the conveyor belt and thereafter disengaging the envelope allowing it to move away from the picker mechanism on the conveyor belt. To assure disengagement of the suction cups from each envelope, the vacuum on the suction cups is turned off upon the cups reaching the level of the conveyor belt.

Figure 8:
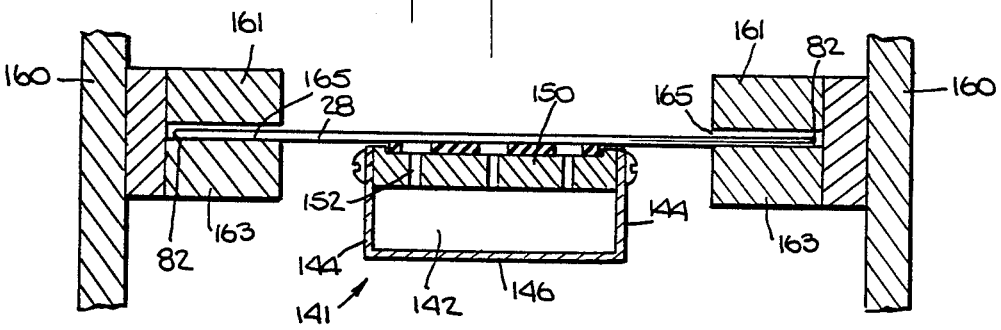
FIG. 8 is a section view of the envelope conveyor and guide members taken along line 8—8 of FIG. 5.
Figure 9:
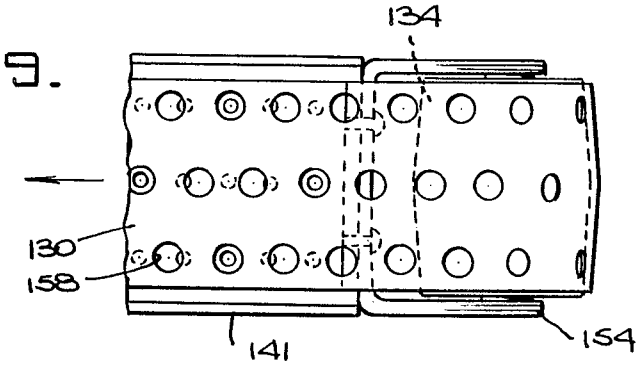
FIG. 9 is a fragmentary view of the envelope conveyor for receiving envelopes removed from the hopper and for conveyance to the loading station.
Figure 11:
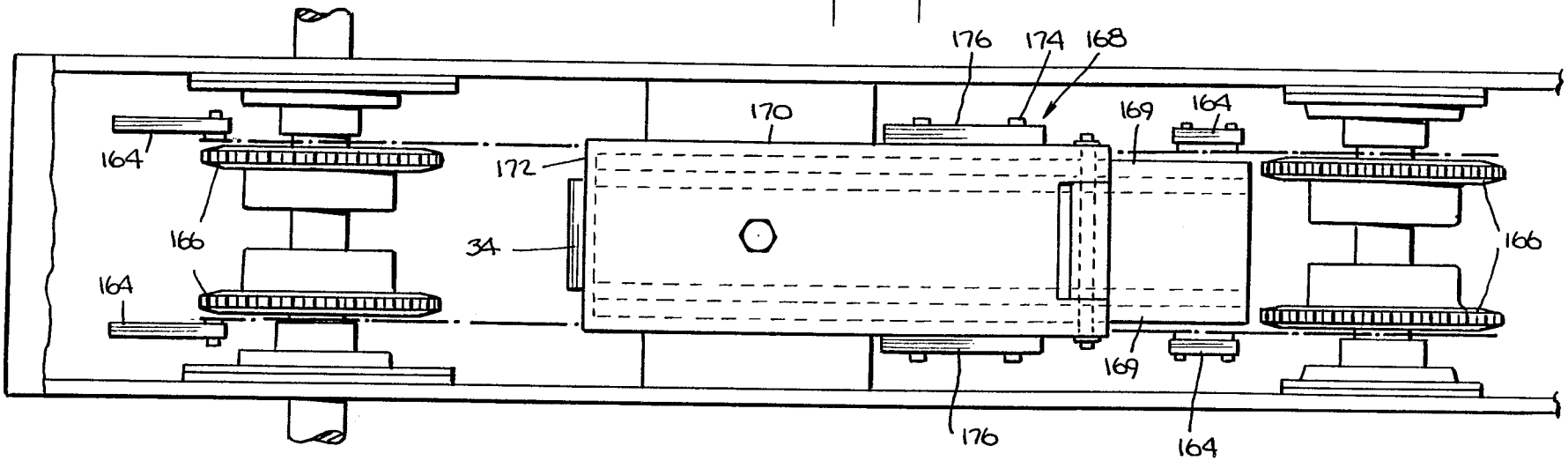
FIG. 11 is a plan view of the overhead pusher assembly.
Figure 10:
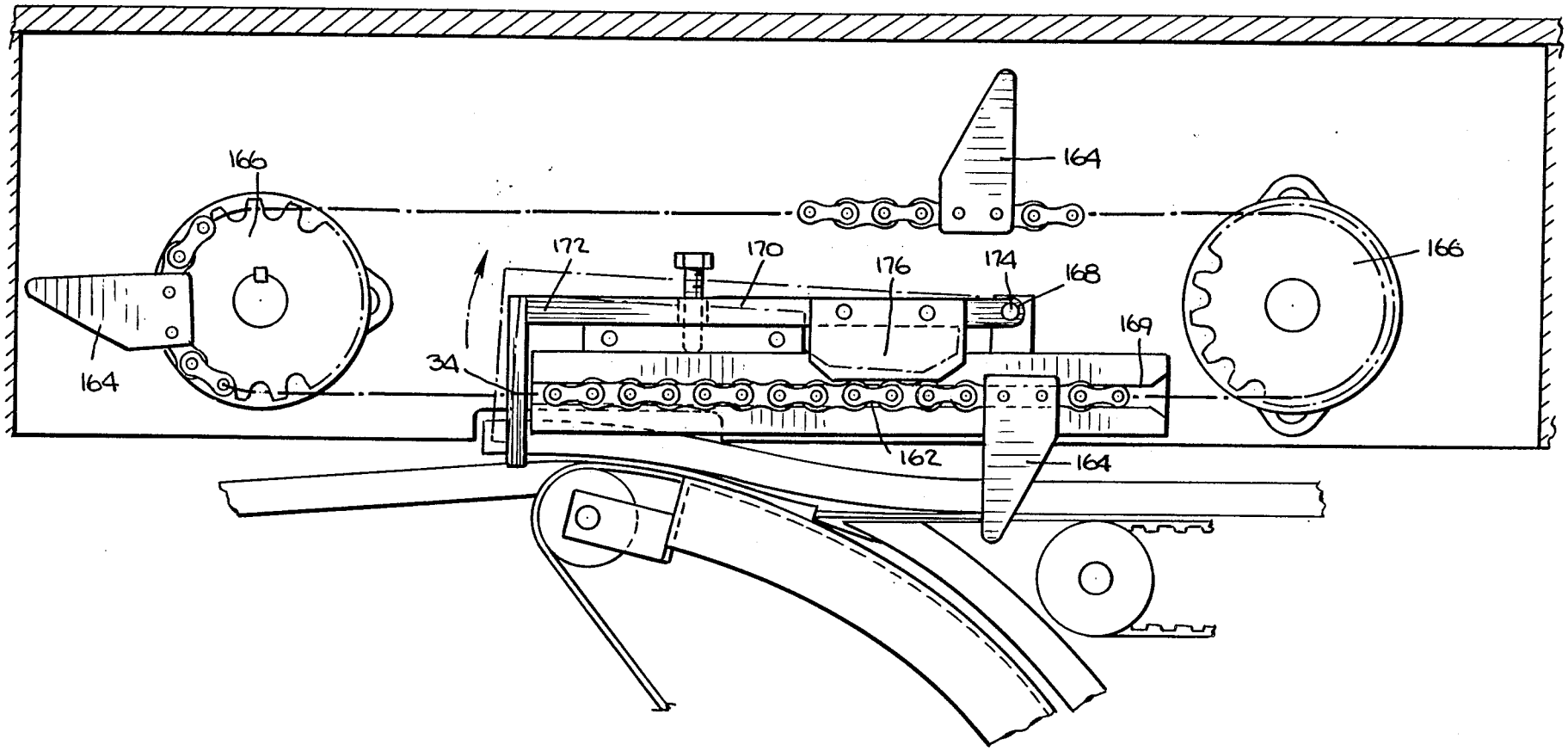
FIG. 10 is a section view of the overhead pusher assembly.

The envelope conveyor 32 (FIG. 5) includes a perforated endless belt 130 having an active run 132 between the envelope hopper 80 and the loading station 22. The endless belt extends around end pulleys 134, 136 and around a drive pulley 137 and a take-up pulley 138 on its return run 140. The perforated conveyor belt cooperates with an evacuated plenum chamber 141 through its active run for holding each envelope to its surface. As best shown in FIGS. 5 and 8, the plenum chamber comprises an elongated box-like chamber 142 with air tight side 144 and bottom 146 walls and a top plate 150 having several rows of perforations 152 extending through its length. The plenum chamber 141 extends along the entire underside of the conveyor belt between the supporting yokes 154 for end pulleys 134 and 136 and defines a convex conveying path 156 for the conveyor belt 130 as it approaches the loading station. As shown in FIG. 9, the belt has several rows of perforations 158 corresponding to the number of rows in the plenum top plate 150. Each of the rows is in longitudinal registry to provide an air pressure differential between the conveyor belt surface and the evacuated plenum chamber 141 for securely holding each envelope to the belt as it is conveyed. The envelope conveyor further includes lateral guide members 160 for engaging and guiding opposite edges 82 of envelopes being conveyed. As shown in FIG. 8, lateral guide members include upper and lower rails 161, 163 defining slot 165 for receiving the marginal edges of each envelope. The upper rails 161 extend from the exit side of the hopper 80 to the underside of the lower diskette guide 68 forming a continuous surface with the end face thereof. The lower rails 163 continue beyong the upper rails following the convex surface of the envelope conveyor and cooperate with the upper diskette guide rails for guiding the package being formed at the loading station.

LOADING STATION AND OVERHEAD PUSHER

The envelope picker mechanism 26 is actuated by the photoelectric pick-up 24 interrupted by a diskette 14 advancing along the diskette gear belt conveyor 16. A corresponding envelope 28 is picked and moved to the loading station 22 coming to rest against the envelope stop 34 and bent backward over the convex terminal portion 162 of the envelope conveyor. See FIG. 12. The top flap 86 of the envelope is restrained and bent backward against the end face 70 of the lower diskette guide rail 68. The horizontal path of the diskette is arranged so that the leading edge 141 of the moving diskette hits the top flap 86 of the envelope before the envelope opening 88. In this manner the "bent backward" or inclined position of envelope guide results in diskette entering the envelope every time in a reliable manner. In addition as shown in FIGS. 4 and 8, the spacing or distance between diskette guides 64, 66 is less than that between envelope guides 160 to ensure that diskette will enter its envelope without catching on a corner edge of the envelope opening.

As shown in FIG. 12, the trailing edge 143 of each diskette is engaged by the cleats 20 of the diskette conveyor and is moved into position for engagement by an overhead pusher assembly 36.

The job of completing the loading of each diskette into its envelope is finished by an overhead pusher 36. Additionally, the overhead pusher removes the envelope stop 34 and clears the completed diskette/envelope package from the loading station. This action is shown in sequence in FIGS. 12–14.

Referring to FIGS. 1 and 10–14, the overhead pusher assembly includes a series of chain 162 mounted lugs or fingers 164 which revolve in timed relation to the passage of diskettes along their conveyor. The lugs are fastened to endless chains mounted over drive sprockets 166. There are two such chain and sprocket arrangements each having spaced cooperating lug sets. Preferably, there are three such sets of lugs. The active run 168 of the lugs is outside the margins of the diskette conveyor belt 16 to provide clear movement beyond the end pulley 56 of the diskette conveyor. Each chain passes through and is supported by a guide member 169 through its active run.

The envelope stop 34 is pivotally mounted at 168 to the overhead pusher assembly. This mounting includes an elongated pivot plate 170 with the envelope stop member depending from the edge remote 172 from the pivot axis 174. A pair of spaced lift cams 176 depend from side edges 178 of the pivot plate for engagement and lifting by the pusher lugs 164 for the purpose of lifting the envelope stop and advancing the diskette/envelope package beyond the loading station and into the stacker and discharge conveyor 42.

As shown in FIGS. 12–14, the diskette has now arrived at loading station 22 being pushed at its trailing-edge 143 by lugs 20 of the diskette conveyor belts 18. The diskette leading edge 141 is entering the open end 88 of stationary envelope 28. As the loading movement continues, the driving lugs 20 have given way to the overhead pusher lugs (FIG. 13) which finish insertion of diskette into envelope. Thereafter, the top surfaces 165 of the pursher lugs 164 engage cam members 176 for pivoting the envelope stop 34 upwardly. Then the package 38 including envelope 28 with diskette 14 continue movement beyond the loading station to the stacking conveyor as shown in FIG. 14.

STACKING CONVEYOR

As shown in FIGS. 1, 15, 16, 17 and 18 the stacking conveyor is oriented to convey in a direction perpendicular to that of the envelope 32 and diskette conveyors 16. The stacking conveyor is intermittently driven and comprises a plurality of U-shaped buckets 180 mounted on and carried by an endless chain 182 arranged over spaced driver 184 and idler 186 sprockets. Each of the buckets includes a base plate 188 and upstanding fore 190 and aft 192 plates or side walls, adjoined to the leading and trailing edges of the base plate. Suitable fittings 194 attached to the underside oof the base plate provide for attachment to the carrier chain. The active run 196 of the carrier chain is guided and supported by a chain guide 198 extending between spaced sprockets. The carrier chain tension is maintained by adjustably mounting the idler sprocket as shown at 200 in FIG. 15.

As shown in FIGS. 15 and 17, the stacking conveyor includes a drive system 202 comprising drive motor 204, a clutch brake 206, a gear reducer 208, and a coupling 210 for moving the drive sprocket 184 fitted to drive shaft 212. The drive system is controlled by a photoelectric circuit 214 (FIGS. 1 and 16) and by a limit switch 216 positioned beneath the bucket conveyor at the loading station 22. The photoelectric circuit is positioned across the path of packages being discharged from the loading station and is programmed to count a predetermined number of packages being loaded into the receiving bucket.

When the count is reached, the conveyor drive 202 is actuated to move the next bucket into the loading position. The limit switch 216 is actuated by the next bucket as it arrives and the conveyor again comes to rest.

It will be observed that envelope and diskette conveyors operate continuously and the stacking conveyor operates intermittently. For efficient cooperation of these conveyors and in order to assure an accurate count of packages in each stock, I have provided a gate mechanism 220 (FIGS. 16 and 18) which extends across the top of the bucket 180 stopping at the loading station. The gate mechanism includes a pair of gate plates 222 slidably mounted in guide members 224 extending along opposite edges 226 of the stacking conveyor above the top edge 228 of the bucket side walls. The gate plates are preferably actuated by air cylinders 230 to slide the gate plates over the bucket conveyor to catch packages as the bucket conveyor advances to the next station. The gate plates retract when the next bucket arrives thereby dropping the packages into the bucket. When the predetermined count is reached the stacking conveyor cycle repeats.

As shown in FIG. 18, each air cylinder 230 is pivotally secured at its cylinder end 232 to a suitable bracket 234. The forward end 236 of the piston rod 238 is secured to its gate plate by a suitable bracket 240 so that the thrust of each air cylinder is along the centerline of its gate plate.

DISCHARGE MECHANISM

The discharge mechanism 242 for moving the stack of diskette packages from each bucket is shown in FIGS. 15 and 17 and includes a discharge ram 244 slidably mounted at the side edge of the stacking conveyor by means of spaced slide bars 246 fitted through slide bearings 248 fixed to a support plate 250. An air cylinder 252 is affixed by suitable pivot connection 254 to the rear side of the discharge ram and the support plate. The discharge ram has a ridge 256 along its lower edge 258 which registers with a groove 260 in the base plate defined by spaced seat members 262 to assure that the bottom diskette package is moved from each loaded bucket. Accordingly, as each loaded bucket arrives at the discharge station the discharge ram sweeps the accumulate stack from the bucket and retreats to the side edge for the next cycle. The discharged stacks are received by a take-away conveyor for further handling.

OPERATION

In operation, diskettes and envelopes are stacked in their respective hoppers and the diskette conveyor, which runs continuously, strips a single disc from the bottom of the diskette hopper. The diskettes are pushed forward by conveyor cleats through a photoelectric beam. The interrupted beam actuates the envelope picking mechanism which removes the bottom envelope from the envelope hopper depositing it on the vacuum belt envelope conveyor which also moves continuously. The envelope conveyor operates at a speed sufficient to deliver each envelope to the diskette/envelope loading station in the position shown in FIGS. 2, 5 and 13 prior to arrival of a corresponding diskette.

At the loading station the envelope comes to rest against the envelope stop and is arched or "back bent" following the convex curvature of the vacuum belt with the top flap of the envelope being depressed by the terminal face of the lower diskette conveyor guides. Accurate and reliable insertion of the diskette is assured as the diskette engages the surface of the top flap prior to the envelope opening. The arched or "bent back" posture of the envelope causes opening of the envelope as the side panels of the envelope are separated. In addition the spacing of the diskette side guides is less than and centered within that of the envelope side guides thereby assuring lateral accuracy of diskette to envelope opening during insertion.

The insertion operation occurs as the overhead fingers engage the rear edges of the diskettes at the exit of the diskette conveyor and push them into waiting envelopes. After insertion, the overhead finger conveyor pivots the envelope stop upwardly by means of the lift cam.

Each emerging package of envelope and diskette passes through a photoelectric beam and is counted. The counted packages enter the stacking conveyor at the stacking station. With the stacking gate open, the packages enter the bucket to form a stack of predetermined count. Thereafter, being actuated by the counting mechanism, the gates close and begin accumulating the next stack, at the same time the bucket conveyor advances one station and the cycle repeats.

At the discharge station each stack is swept from the stacking bucket to a take-away conveyor.

I claim:

1. A machine for inserting diskettes into envelopes having side panels and a top flap comprising:

means for receiving and holding a plurality of diskettes in a stack, means for engaging and removing one diskette at a time from the stack, means for receiving each diskette from the stack and for conveying the diskette toward a loading station, actuator means responsive to the movement of each diskette, means for receiving and holding a plurality of envelopes in a stack, said envelope having side panels sealed along three sides and an open top flap, means responsive to said actuator means for removing one envelope at a time from its stack, means for receiving each removed envelope and for conveying each envelope to the loading station ahead of the diskette, means for retaining the envelope at the loading station, means for back bending the envelope at the loading station to open the envelope, means for depressing the top flap below the path of travel of the diskette, means for centering the diskette with respect to the opening in the envelope, means for moving the diskette into the envelope and means for discharging the filled envelope from the loading station.

2. A machine according to claim 1 in which the means for receiving and holding diskettes includes a rake member having a lower margin spaced above the diskette conveyor a distance approximately equal to the thickness of a diskette.

3. A machine as defined in claim 1 in which the diskette conveyor includes spaced conveying belts fitted with cleats for engaging the trailing edge of the bottom diskette in the stack and for moving the diskette toward the loading station.

4. A machine as defined by claim 1 which further includes means for guiding the marginal edges of each diskette being moved toward the loading station, and means for guiding the marginal edges of each envelope being moved toward the loading station.

5. A machine as defined in claim 4 in which the spacing between diskette guide members is less than that between envelope guide members so that diskettes are positioned centrally of envelope opening at the loading station.

6. A machine as defined in claim 4 in which the diskette guiding means comprises two pairs of upper and lower rails on opposite sides of the diskette conveyor with the upper end lower rails of each pair being spaced to define slot for guiding the marginal edges of diskettes, and further in which the envelope guiding means comprises two pairs of upper and lower rails on opposite sides of the envelope conveyor with the upper and lower rails of each pair being spaced apart to define slots for guiding the marginal edges of the envelopes.

7. A machine as defined in claim 6 in which the upper diskette rails and the lower envelope rails cooperate at the loading station to define respectively upper and lower guide rails for packages being formed at the loading station.

8. A machine as defined in claim 6 in which the lower guide rails of the diskette conveyor terminate at a margin of the loading station with the end surfaces of said rails engaging and depressing the top flap of each envelope positioned at the loading station.

9. A machine as defined in claim 8 in which the terminal portion of the envelope, and the terminal portions of both the upper diskette guide rails and the lower envelope rails lie along a convex curve defining means for bending back the envelopes at the loading station.

10. A machine as defined in claim 1 in which the means for moving the diskette into the envelope comprises an overhead pusher assembly having an endless conveyor mounted above and substantially parallel to the diskette conveyor, a plurality of depending pusher members being moved by said conveyor for engaging the trailing edges of diskettes and for moving the diskettes into said envelopes.

11. A machine as defined by claim 10 in which the loading station envelope retaining means is pivotally mounted to said overhead pusher assembly, and includes a depending stop for retaining envelopes at the loading station.

12. A machine as defined in claim 11 in which said retaining means includes a cam member, and said pusher members engaging the cam member to lift the retaining means thereby releasing the formed package to be pushed by the pusher members from the loading station.

13. A machine for inserting diskettes into envelopes to form packages and for accumulating given counts of packages comprising:

means for receiving and holding a plurality of diskettes in a stack, means for engaging and removing one diskette at a time from the stack, means for receiving each diskette from the stack and for conveying the diskette toward a loading station, actuator means responsive to the movement of each diskette, means for receiving and holding a plurality of envelopes in a stack, said envelope having side panels sealed along three sides and an open top flap, means responsive to said actuator means for removing one envelope at a time from its stack, means for receiving each removed envelope and for conveying each envelope to the loading station ahead of the diskette, means for retaining the envelope at the loading station, means for back bending the envelope at the loading station to open the envelope, means for depressing the top flap below the path of travel of the diskette, means for centering the diskette with respect to the opening in the envelope, means for moving the diskette into the envelope, means for discharging the packages from the loading station, means for detecting each package leaving the loading station, a package conveyor having a plurality of members for receiving a predetermined number of packages from the loading station, means responsive to the detecting means for advancing the package conveyor to present another receiving member at the loading station after the predetermined count has been reached, and means for discharging the packages from the receiving member.

14. A machine as defined in claim 13 in which the package conveyor has a direction of conveyance perpendicular to that of diskette conveyor, and comprises a plurality of bucket members mounted for intermittent movement on an endless conveying member.

15. A machine as defined in claim 14 which further includes a gate member responsive to said detecting means for closing over the top of the bucket members and for retaining packages arriving from the loading station as the bucket conveyor advances, thereafter depositiing the partial stack of packages into the next arriving bucket.

16. A machine as defined in claim 13 in which the discharging means includes a reciprocating ram member for pushing stacks of packages from each bucket arriving at the discharge station.

17. A machine as defined in claim 16 in the which each bucket comprises a base member and upstanding side members in a U-shape.

18. A machine as defined in claim 17 in which the base member includes spaced seat members defining a groove opening into the receiving area of each bucket, and further wherein the discharge ram is fitted with a ridge along its lower surface cooperating with the groove to assure removal of the full stack of packages from each bucket.

* * * * *